US011802323B2

(12) United States Patent
Goswami et al.

(10) Patent No.: US 11,802,323 B2
(45) Date of Patent: Oct. 31, 2023

(54) SUPPRESSION OF SAMSON PHASE FORMATION IN AL—MG ALLOYS BY BORON ADDITION

(71) Applicant: The Government of the United States of America, as represented by the Secretary of the Navy, Arlington, VA (US)

(72) Inventors: Ramasis Goswami, Alexandria, VA (US); Syed B. Qadri, Fairfax Station, VA (US)

(73) Assignee: The Government of the United States of America, as represented by the Secretary of the Navy, Arlington, VA (US)

( * ) Notice: Subject to any disclaimer, the term of this patent is extended or adjusted under 35 U.S.C. 154(b) by 72 days.

(21) Appl. No.: 17/307,390

(22) Filed: May 4, 2021

(65) Prior Publication Data

US 2021/0317549 A1 Oct. 14, 2021

Related U.S. Application Data

(62) Division of application No. 15/977,482, filed on May 11, 2018, now Pat. No. 11,028,462.

(60) Provisional application No. 62/510,048, filed on May 23, 2017.

(51) Int. Cl.

| | |
|---|---|
| ***C22C 1/03*** | (2006.01) |
| ***C22C 1/02*** | (2006.01) |
| ***C22C 21/06*** | (2006.01) |
| ***C22C 1/10*** | (2023.01) |
| ***C22F 1/047*** | (2006.01) |

(52) U.S. Cl.

CPC ..... *C22C 1/03* (2013.01); *C22C 1/026* (2013.01); *C22C 1/1094* (2013.01); *C22C 21/06* (2013.01); *C22F 1/047* (2013.01)

(58) Field of Classification Search

CPC ..... C22C 1/03; C22C 1/026; C22C 1/1094; C22C 21/06; C22C 1/02; C22F 1/047

USPC ..... 148/549

See application file for complete search history.

(56) References Cited

U.S. PATENT DOCUMENTS

| | | | | |
|---|---|---|---|---|
| 2004/0091386 | A1* | 5/2004 | Carroll | C22C 21/06 148/439 |
| 2006/0137783 | A1* | 6/2006 | Aruga | G21C 19/40 148/689 |
| 2016/0186301 | A1* | 6/2016 | Taheri | C22F 1/04 148/439 |

* cited by examiner

*Primary Examiner* — Brian D Walck
*Assistant Examiner* — Danielle Carda
(74) *Attorney, Agent, or Firm* — US Naval Research Laboratory; Stephen T. Hunnius

(57) ABSTRACT

An aluminum magnesium alloy with reduced Samson phase at grain boundaries made from the method of providing aluminum in a container, adding boron to the container, providing an inert atmosphere, arc-melting the aluminum and the boron, and mixing the aluminum and the boron in the container to form an alloy mixture. A method of suppressing the Samson phase, $Al_3Mg_2$, at grain boundaries in Aluminum, comprising providing aluminum in a container, adding boron to the container, providing an inert atmosphere, arc-melting the aluminum and the boron, and mixing the aluminum and the boron in the container to form an alloy mixture.

2 Claims, 5 Drawing Sheets

SUPPRESSION OF SAMSON PHASE FORMATION IN AL—MG ALLOYS BY BORON ADDITION

REFERENCE TO RELATED APPLICATION

This application is a non-provisional of, and claims priority to and the benefits of, U.S. Provisional Patent Application No. 62/510,048 filed on May 23, 2017, and U.S. patent application Ser. No. 15/977,482 filed on May 11, 2018, the entirety of each is hereby incorporated by reference.

BACKGROUND

This disclosure teaches suppression of Samson Phase formation in Al—Mg Alloys by boron addition.

Considerable work has been done on the complex $Al_3Mg_2$ intermetallic compound, known as Samson phase. It is a cubic structure with space group: m3m, lattice parameter 28.239 Å and 1170 atoms per unit cell.

In Al—Mg alloys, particularly in Al 5083 and Al 5456, this phase precipitates out from the supersaturated Al—Mg solid solution as a result of thermal exposure in the range of 50-200° C.

It mostly forms at grain boundaries in Al—Mg alloys, which makes them susceptible to intergranular corrosion (IGC) and stress corrosion cracking (SCC) as the grain boundary intermetallic phase is highly anodic relative to the Al matrix.

This leads to a catastrophic structural failure via anodic dissolution of the grain boundary phase upon exposure to seawater and stress.

It is a longstanding problem of naval vessels, which use Al 5000 series alloys in order to decrease the overall weight and fuel consumption, and to increase the speed.

Recently, different thermo mechanical treatments, alloy additions of Sr, Nd and Zn and local reversion of thermal treatments have been applied to minimize the formation of the grain boundary Samson phase and sensitization. However, these prior art methods are not effective in preventing the formation of grain boundary $Al_3Mg_2$.

We report here for the first time the prevention of this phase at grain boundaries in Al 5083 by alloying with B and Cu that reduces the supersaturation of Mg, which is the thermodynamic driving force for the precipitation of $Al_3Mg_2$ in Al matrix.

SUMMARY OF DISCLOSURE

Description

This disclosure teaches a new method of suppressing the Samson phase, $Al_3Mg_2$.

This disclosure teaches a new method of suppressing the Samson phase, $Al_3Mg_2$, at grain boundaries in Al 5083 by alloying with B, which traps most of Mg in solid solution as $AlMgB_2$ phase.

This disclosure teaches a new method to decrease the supersaturation level of Mg in Al matrix, which is a driving force for the formation of Samson phase in Al 5083.

We observe Cu-rich precipitates, instead of the Samson phase, at grain boundaries upon extended annealing at 150° C.

This is a significant finding as it provides new insight as to how to minimize the longstanding problem of sensitization.

DESCRIPTION OF THE DRAWINGS

The following description and drawings set forth certain illustrative implementations of the disclosure in detail, which are indicative of several exemplary ways in which the various principles of the disclosure may be carried out. The illustrated examples, however, are not exhaustive of the many possible embodiments of the disclosure. Other objects, advantages and novel features of the disclosure will be set forth in the following detailed description when considered in conjunction with the drawings.

DETAILED DESCRIPTION OF THE INVENTION

This disclosure teaches a new method of suppressing the Samson phase, $Al_3Mg_2$.

This invention is concerned with a new method of suppressing the Samson phase, $Al_3Mg_2$, at grain boundaries in Al 5083 by alloying with B, which traps most of Mg in solid solution as $AlMgB_2$ phase.

Our new method decreases the supersaturation level of Mg in Al matrix, which is a driving force for the formation of Samson phase in Al 5083.

We observe Cu-rich precipitates, instead of the Samson phase, at grain boundaries upon extended annealing at 150° C.

This is a significant finding as it provides new insight as to how to minimize the longstanding problem of sensitization.

Boron is known to form di-boride compounds, $MgB_2$ and $AlB_2$, with Mg and Al, respectively. These di-boride compounds crystallize in hexagonal (P6/mmm) structure with lattice parameters, a=3.08 Å and c=3.51 Å for $MgB_2$, a=3.01 Å and c=3.24 Å for $AlB_2$.

In the present work, however, the ternary Al—Mg boride particles, as evidenced by XRD and TEM, form in Al matrix. As $MgB_2$ has the same structure as $AlB_2$ it is more likely to substitute the Al atoms in the $AlB_2$ lattice.

Example 1

Figure 1:
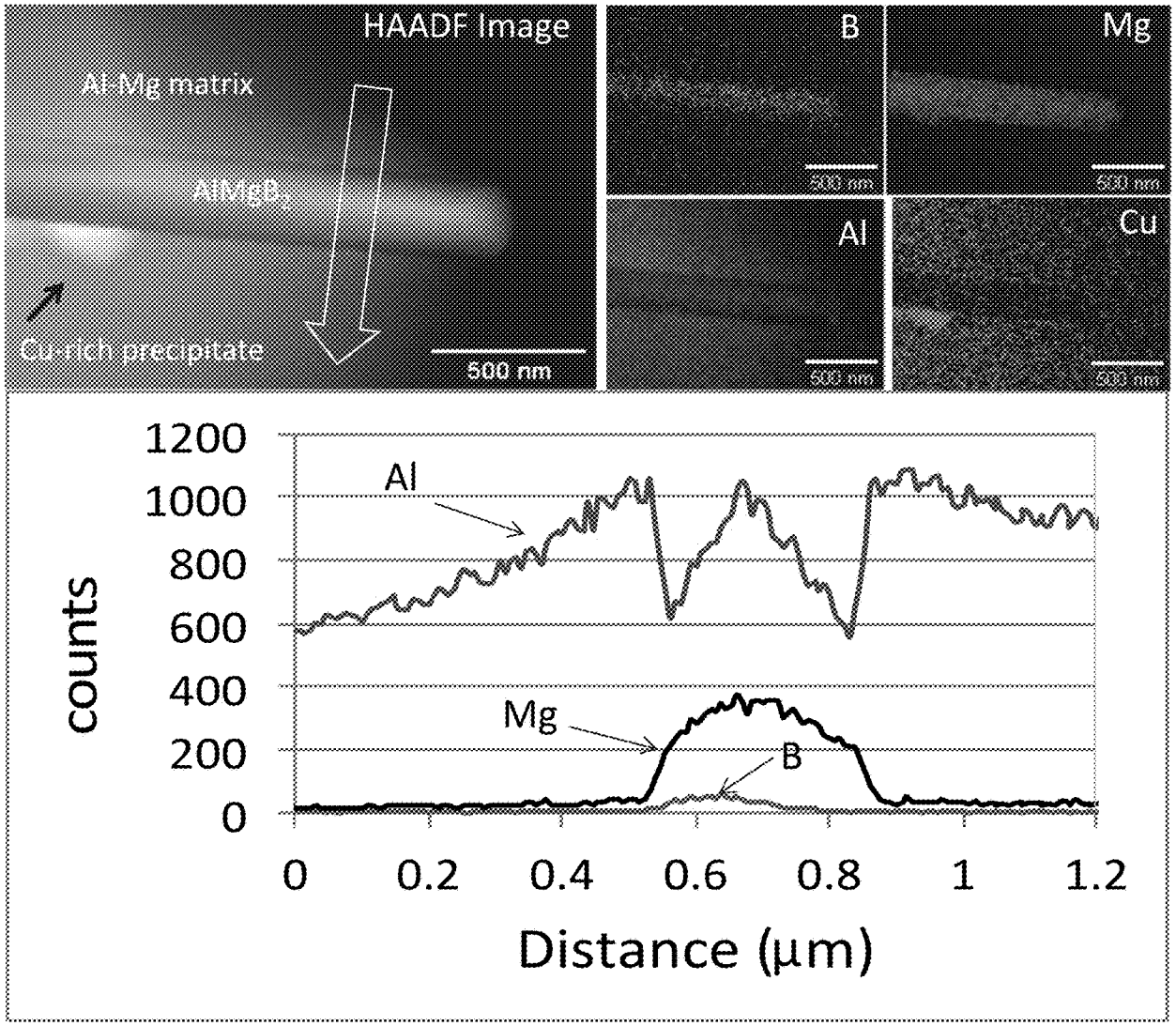
FIG. 1 is a HAADF image showing the rod like boride particle, fine probe EDS maps showing the distribution of B, Mg, Al and Cu, respectively, and a line-scan across the particle.
Figure 2:
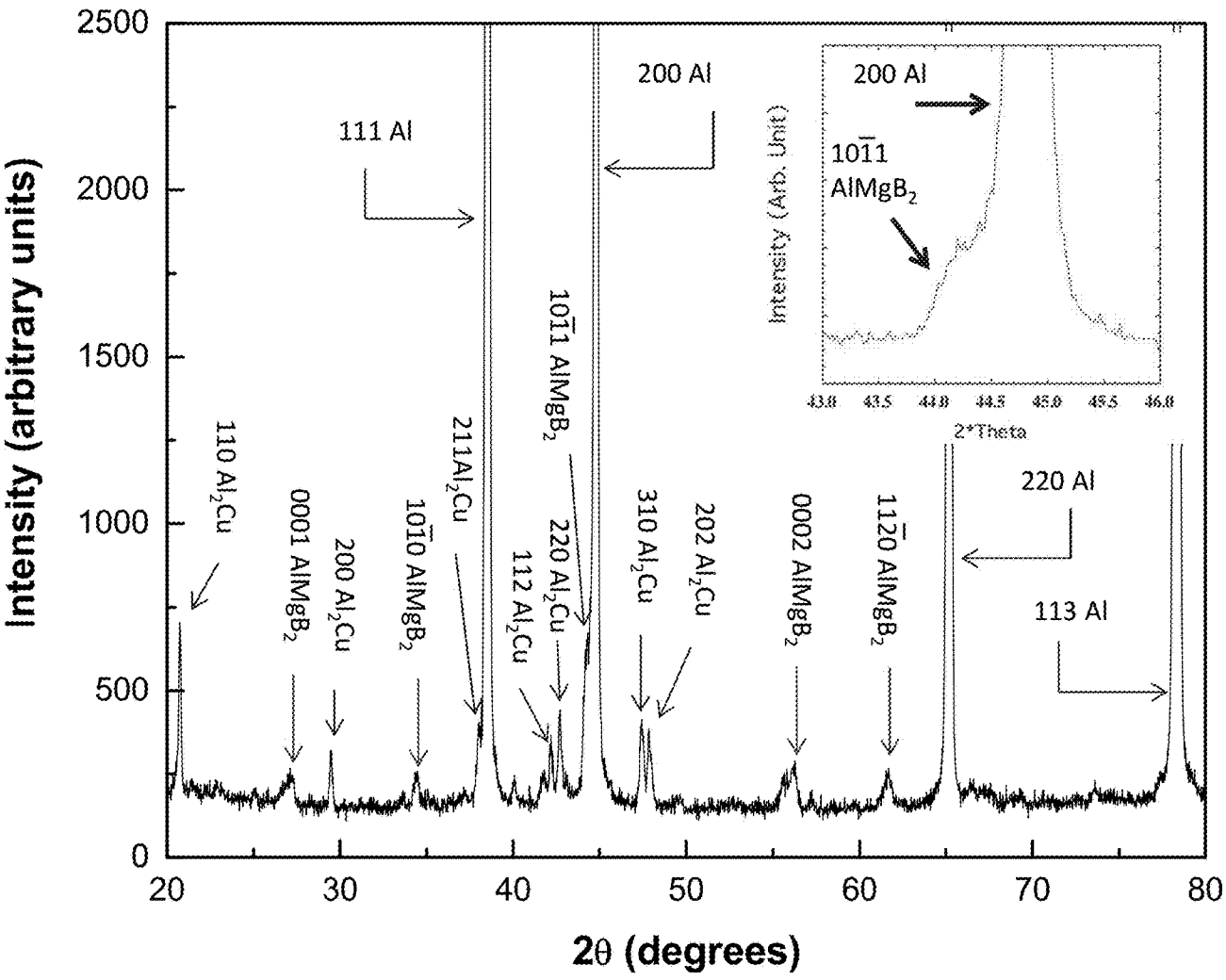
FIG. 2 is a XRD showing the $AlMgB_2$ and $Al_2Cu$ precipitates in Al matrix. Inset shows the 10-11 boride peak.

FIG. 1 shows the HAADF image of one such rod-like boride particle in an Al matrix in the as-cast condition. The fine-probe EDS map shows that it is a Al—Mg ternary boride particle with considerable amount of Mg.

The distribution of B, Mg, Al, and Cu in the boride particle and matrix is shown in FIG. 1.

A line scan, FIG. 1, across the particle shows considerable drop in Al counts close to the broad faces as compared to the core, suggesting that $AlB_2$ forms initially during solidification and then Mg diffuses through the broad faces. In addition, Cu-rich precipitates, appeared bright in the HAADF image, were observed on top of the boride particle.

Example 2

X-ray diffraction (XRD) clearly shows α-Al, $Al_2Cu$ and $AlMgB_2$ upon extended annealing. In addition, a small volume fraction of Al—Mn—Cr—Fe type dispersoids exists in this alloy. Note that the peaks corresponding to 2θ=27.187 and 56.14 have been shifted to the lower angles as compared to the 0001 and 0002 of $AlB_2$, suggesting that the c-parameter increases as a result of insertion of Mg in $AlB_2$ lattice.

In fact, the c-parameter of the boride phase is 3.28 Å, while the a-parameter does not change significantly with respect to $AlB_2$. Using Vegard's law, the ratio of Al and Mg in the ternary boride turns out to be 3:1.

Example 3

Figure 3:
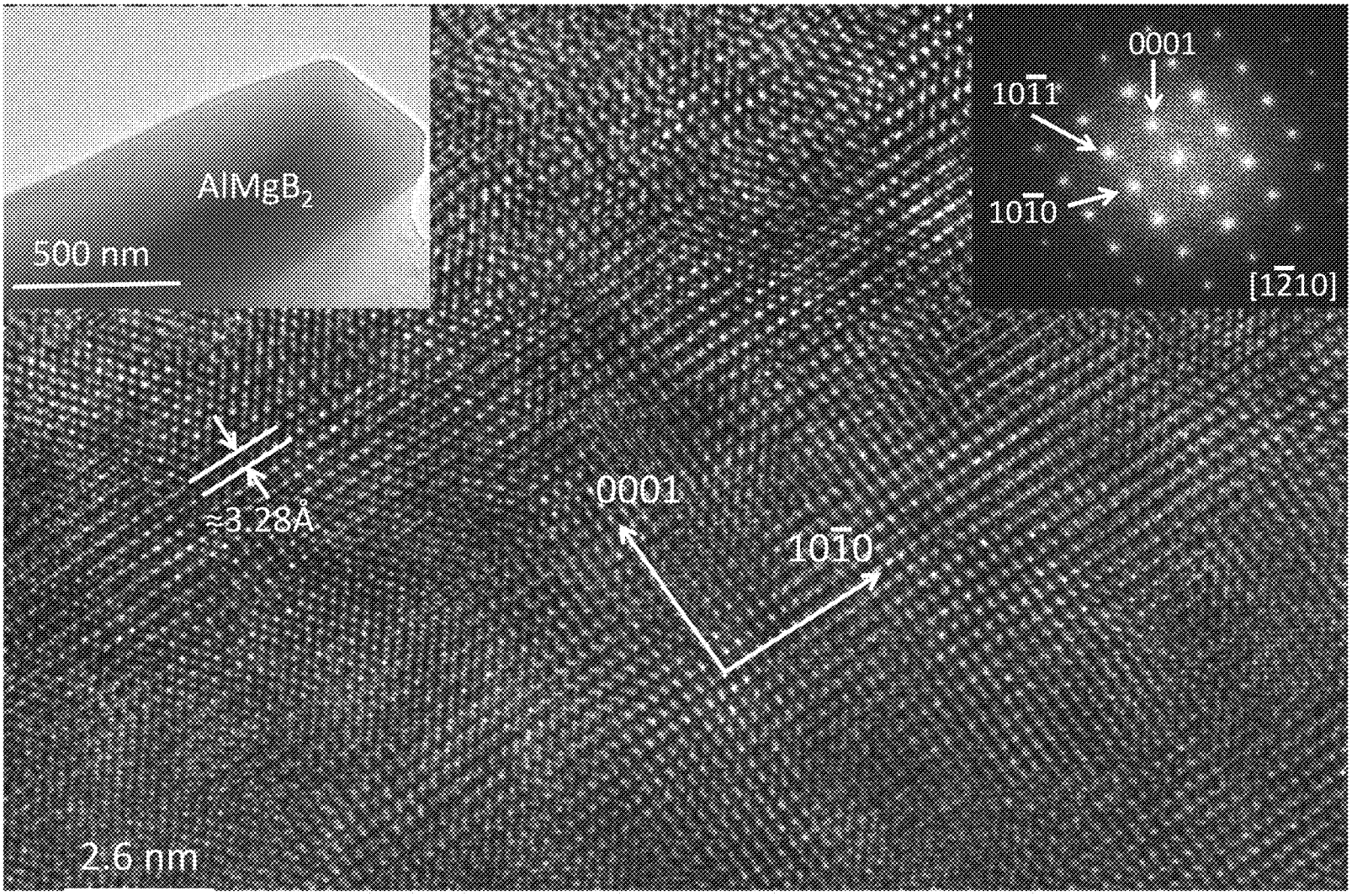
FIG. 3 is a HRTEM image of the boride particle. A low magnification TEM image of the boride particle and the FFT pattern are shown as left and right insets, respectively.

FIG. 3 is a HRTEM image obtained from a portion of rod-like $AlMgB_2$ particle showing the lattice fringes of 0001, 10-10 and 10-11 planes close to the [11-20] zone.

The corresponding fast Fourier transform (FFT) obtained from part of the image is given as a right inset, showing the 0001, 10-10 reflections with d-spacing 3.28 Å and ≈2.6 Å, respectively, which is consistent with XRD observations.

Example 4

Figure 4:
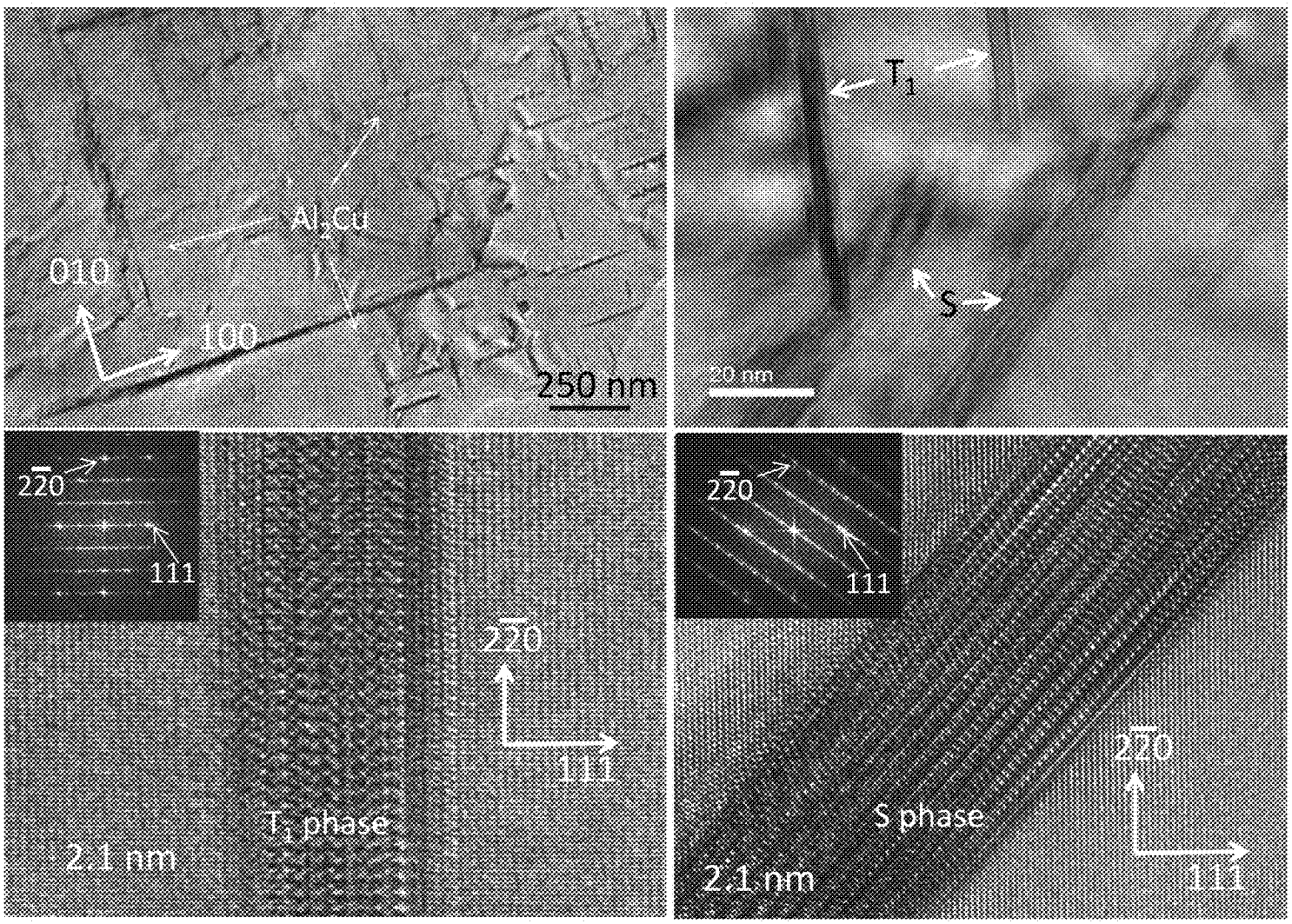
FIG. 4 illustrates TEM images showing different precipitates in Al matrix: $Al_2Cu$, a multibeam image showing the S and $T_1$ precipitates, and HRTEM images of $T_1$ and S-phase close to [11-2] zone of Al. The corresponding FFTs obtained from part of the matrix and precipitate are shown as insets.

In addition to boride phases, we have observed several Cu-rich nanocrystalline precipitates, such as $Al_2Cu$ (θ'), $Al_2CuMg$ (S-phase) and $Al_2CuMg$ ($T_1$ phase) upon extended annealing (see FIG. 4).

All these Cu-rich precipitates enhance the strength of the alloy. To study the grain boundary microstructure, we examined number of grain boundaries for samples annealed at 150° C. for 190 h.

Example 5

Figure 5:
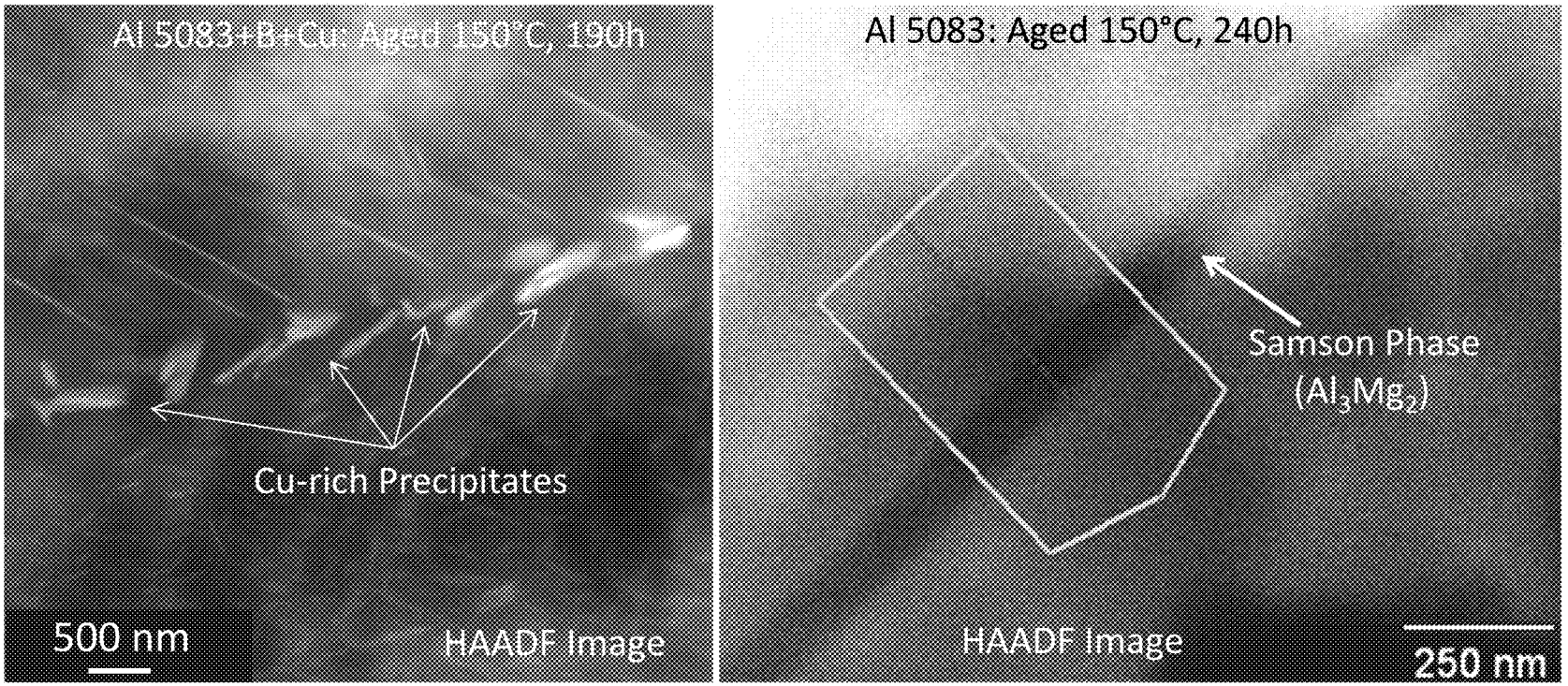
FIG. 5 is a HAADF image showing Cu-rich precipitates at grain boundary for sample annealed at 150° C. for 190 h.

FIG. 5 is a typical HAADF image showing the grain boundary precipitates.

Most precipitates appeared bright in the HAADF imaging mode, suggesting that these precipitates are Cu rich.

They are mostly S-phase as confirmed by HRTEM. In the HAADF imaging mode, however, the Samson phase, as it is enriched with Mg, appears darker as compared to the matrix.

Example 6

We demonstrated that the Samson phase formation in Al 5083 has been suppressed by alloying with B and Cu.

TEM and XRD revealed that a ternary boride compound, $AlMgB_2$, forms along with Cu-rich nanocrystalline precipitates in Al matrix.

The $AlMgB_2$ phase formation decreases the supersaturation level of Mg in Al matrix, which is a driving force for the formation of Samson phase in Al 5083.

Upon extended annealing at 150° C., we observe Cu-rich precipitates at grain boundaries.

Example 7

An ingot with Al-5083 with some amount of B and Cu was produced by arc melting in an inert atmosphere.

Such ingot was melted several times to ensure the homogeneity, and allowed to cool in the furnace.

The ingot was homogenized at 500° C. for 2 h and annealed at 150° C. for 190 h. Samples for TEM were prepared using an ion mill with a gun voltage of 4 kV for each gun, and a sputtering angle of 10°. A JEOL-2200FX analytical transmission electron microscope was then employed to examine the microstructure and composition. Fine-probe energy dispersive X-ray spectroscopy (EDS) was used to determine the distribution of B, Cu and Al.

Further compositional information was obtained with high-angle annular dark field (HAADF) imaging.

For structural analysis, we use x-ray diffraction (XRD) using Rigaku diffractometer utilizing Cu Kα1 radiation.

We demonstrated that the Samson phase formation in Al 5083 has been suppressed by alloying with B and Cu. TEM and XRD revealed that a ternary boride compound, $AlMgB_2$, forms along with Cu-rich nanocrystalline precipitates in Al matrix. The $AlMgB_2$ phase formation decreases the supersaturation level of Mg in Al matrix, which is a driving force for the formation of Samson phase in Al 5083. Upon extended annealing at 150° C., we observe Cu-rich precipitates at grain boundaries.

The above examples are merely illustrative of several possible embodiments of various aspects of the present disclosure, wherein equivalent alterations and/or modifications will occur to others skilled in the art upon reading and understanding this specification and the annexed drawings. In addition, although a particular feature of the disclosure may have been illustrated and/or described with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising".

What we claim is:

1. An aluminum-magnesium-manganese-iron-copper-chromium-titanium-silicon alloy comprising boron with reduced or no Samson phase, $Al_3Mg_2$, at grain boundaries in aluminum, made from the method of:

providing aluminum in a container;

adding boron to the container;

providing an inert atmosphere;

arc-melting the aluminum and the boron;

mixing the aluminum and the boron in the container to form an alloy mixture;

wherein the aluminum is Al-5083;

wherein the boron reduces supersaturation of magnesium;

wherein the boron traps the magnesium in a solid solution as $AlMgB_2$ phase;

further comprising the steps of adding copper to the container prior to the step of providing an the inert atmosphere;

arc-melting the aluminum and the boron and the copper;

mixing and homogenizing the aluminum, the boron and the copper in the container to form an alloy mixture with reduced or no Samson phase, $Al_3Mg_2$;

wherein the step of mixing and homogenizing is at 500° C. for 2 hours; and annealing at 150° C. for about 190 hours.

2. An aluminum-magnesium-manganese-iron-copper-chromium-titanium-silicon alloy comprising boron with reduced or no Samson phase, $Al_3Mg_2$, at grain boundaries in aluminum, comprising:

aluminum;

boron;

with reduced or no Samson phase, $Al_3Mg_2$, wherein the aluminum and the boron are arc-melted;

wherein the aluminum and the boron are mixed to form an alloy mixture;

wherein the aluminum is Al-5083 or Al-5456;

wherein the boron reduces supersaturation of magnesium;

wherein the boron traps the magnesium in a solid solution as $AlMgB_2$ phase;

copper and wherein the aluminum and the boron and the copper are arc-melted and undergo mixing and homogenizing to form an alloy mixture and annealed;

wherein the mixing and homogenizing is at 500° C. for 2 hours; and wherein annealed at 150° C. for about 190 hours.

* * * * *